US006801168B1

(12) United States Patent
Yeh

(10) Patent No.: US 6,801,168 B1
(45) Date of Patent: Oct. 5, 2004

(54) PLANAR DOUBLE L-SHAPED ANTENNA OF DUAL FREQUENCY

(75) Inventor: Ming-Hau Yeh, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 6 days.

(21) Appl. No.: 10/403,125

(22) Filed: Apr. 1, 2003

(51) Int. Cl.[7] ..... H01Q 1/38

(52) U.S. Cl. ..... 343/700 MS; 343/702; 343/846

(58) Field of Search ..... 343/700 MS, 702, 343/846

(56) References Cited

U.S. PATENT DOCUMENTS

2004/0017315 A1 * 1/2004 Fang et al. ..... 343/700 MS

* cited by examiner

*Primary Examiner*—Hoang V. Nguyen
(74) *Attorney, Agent, or Firm*—Bacon & Thomas PLLC

(57) ABSTRACT

The present invention is to provide a planar double L-shaped antenna operable at two different frequency ranges comprising a patch line printed on a top of a dielectric substrate and having one end formed as a signal feed point; a ground metal plate printed on a bottom of the dielectric substrate; a first radiating element formed at the other end of the patch line and extended in a direction perpendicular to the patch line above and beyond the ground metal plate to shape as an inverted L shape; and a second radiating element extended beyond the ground metal plate to shape as an inverted L shape and spaced apart from the first radiating element, so that the first and the second radiating elements are capable of receiving signals having different frequencies.

10 Claims, 10 Drawing Sheets

PLANAR DOUBLE L-SHAPED ANTENNA OF DUAL FREQUENCY

FIELD OF THE INVENTION

The present invention relates to antennas and more particularly to an improved planar double L-shaped antenna capable of operating at two different frequency ranges.

BACKGROUND OF THE INVENTION

A conventional sleeve (or L-shaped) antenna mounted in a wireless communication device is illustrated in FIG. 1. As shown, the antenna comprises a coaxial transmission line 10 including an inner conductor (or core) 14, an outer conductor (or shielded mesh or ground line) 16, and a cylinder 17 of insulated dielectric material sandwiched between the inner and outer conductors 14 and 16 so that a concentric conductor as known in the electromagnetism is formed by both the inner and outer conductors 14 and 16. Moreover, an insulated shell 19 is formed around the coaxial transmission line 10. The coaxial transmission line 10 has one end coupled to a control circuit (not shown) of the wireless communication device so that the coaxial transmission line 10 can be served as a feed line. A ground metal plate 18 is formed on the other end of the coaxial transmission line 10. The ground metal plate 18 is coupled to the outer conductor 16 so as to electrically ground the outer conductor 16 of the coaxial transmission line 10. An extension 12 is formed from the inner conductor 14 at the other end of the coaxial transmission line 10. The extension 12 is shaped like an inverted L shape and extends beyond the ground metal plate 18. A length of the inverted L-shaped extension (i.e., radiating element) 12 is closely related to a resonant frequency of the antenna which is typically operated at a single frequency.

For making the L-shaped antenna more compact, a technique of manufacturing the antenna on a printed circuit board is adopted by some manufacturers in the art as shown in FIG. 2. The L-shaped antenna comprises a dielectric substrate 27, a patch line 24 printed on the top of the dielectric substrate 27, the patch line 24 having one end formed as a signal feed point 241, a ground metal plate 28 printed on the bottom of the dielectric substrate 27 opposite to the patch line 24, and an inverted L-shaped radiating element 242 formed at the other end of the patch line 24, the inverted L-shaped radiating element 242 being extended in a direction perpendicular to the patch line 24 above and beyond the ground metal plate 28. A length of the inverted L-shaped radiating element 242 is closely related to a resonant frequency of the antenna which is typically operated at a single frequency.

Further, for the purpose of using a coplanar wave guide as a feed line, another technique of manufacturing the L-shaped antenna on a printed circuit board is adopted by some manufacturers in the art as shown in FIG. 3. The coplanar wave guide based L-shaped antenna comprises a dielectric substrate 37, a coplanar wave guide line 34 printed on the top of the dielectric substrate 37, the coplanar wave guide line 34 having one end formed as a signal feed point 341, two spaced ground metal plates 38 printed on the top of the dielectric substrate 37 (i.e., the same surface as the coplanar wave guide line 34) with the coplanar wave guide line 34 located therebetween and spaced apart, and an inverted L-shaped radiating element 342 formed at the other end of the coplanar wave guide line 34, the inverted L-shaped radiating element 342 being extended in a direction perpendicular to the coplanar wave guide line 34 and beyond the ground metal plates 38. A length of the inverted L-shaped radiating element 342 is closely related to a resonant frequency of the antenna which is typically operated at a single frequency.

There has been a significant growth in wireless local Area network (WLAN) due to an increasing demand of mobile communication products in recent years in which IEEE 802.11 WLAN protocol is the most important one among a variety of WLAN standards. The IEEE 802.11 WLAN protocol was established in 1997. The IEEE 802.11 WLAN protocol not only provides many novel functions for WLAN based communication but also proposes a solution for communicating between mobile communication products made by different manufacturers. There is no doubt that the use of the IEEE 802.11 WLAN protocol is a milestone in the development of WLAN. The IEEE 802.11 WLAN protocol was further modified for being adapted to serve as a standard of both IEEE/ANSI and ISO/IEC in August 2000. The modifications comprise IEEE 802.11a WLAN protocol and IEEE 802.11b WLAN protocol. In an expanded standard physical layer, the operating frequencies have to be set at 5 GHz and 2.4 GHz. As such, the well-known L-shaped antenna cannot satisfy the requirement of enabling a mobile communication product to use both IEEE 802.11a and IEEE 802.11b WLAN protocols at the same time. Instead, several antennas have to be mounted in the product for complying with the requirement of frequency band. However, such can increase a manufacturing cost, complicate an installation procedure, and consume precious space for mounting the antennas. As a result, the size of the product cannot be reduced, thereby contradicting the compactness trend.

SUMMARY OF THE INVENTION

A primary object of the present invention is to provide a planar double L-shaped antenna of dual frequency for fulfilling the need of multi-frequency operation which is unobtainable by a conventional antenna only operated at a single frequency.

One object of the present invention is to provide a planar double L-shaped antenna operable at two different frequency ranges comprising a dielectric substrate; a patch line printed on a top of the dielectric substrate, the patch line having one end formed as a signal feed point; a ground metal plate printed on a bottom of the dielectric substrate; and first and second radiating elements wherein the first radiating element is formed at the other end of the patch line and extended in a direction perpendicular to the patch line above and beyond the ground metal plate to shape as an inverted L shape, and the second radiating element is adjacent the first radiating element, extended beyond the ground metal plate to shape as an inverted L shape, and spaced apart from the first radiating element and extended in a direction either opposite to or the same as that of the first radiating element so that the first and the second radiating elements are capable of receiving signals having different frequencies.

Another object of the present invention is to provide a planar double L-shaped antenna operable at two different frequency ranges comprising a dielectric substrate; a coplanar wave guide line printed on a top of the dielectric substrate, the coplanar wave guide line having one end formed as a signal feed point; two spaced ground metal plates printed on the top of the dielectric substrate with the coplanar wave guide line located therebetween and spaced apart; and first and second radiating elements wherein the first radiating element is formed at the other end of the coplanar wave guide line and extended in a direction perpendicular to the coplanar wave guide line and beyond the ground metal plates to shape as an inverted L, and the second radiating element is extended from one of the ground metal plates to shape as an inverted L, spaced apart from the first radiating element and extended in a direction either opposite to or the same as that of the first radiating element so that the first and the second radiating elements are capable of receiving signals having different frequencies.

In one aspect of the present invention a length of each of the first and the second radiating elements is about one-quarter wavelength at each operating frequency of the frequency ranges so that the first and the second radiating elements are capable of receiving signals of dual frequency as stipulated by IEEE 802.11a protocol and IEEE 802.11b protocol respectively.

The above and other objects, features and advantages of the present invention will become apparent from the following detailed description taken with the accompanying drawings.

DETAILED DESCRIPTION OF THE PREFERRED EMBODIMENTS

Figure 1:
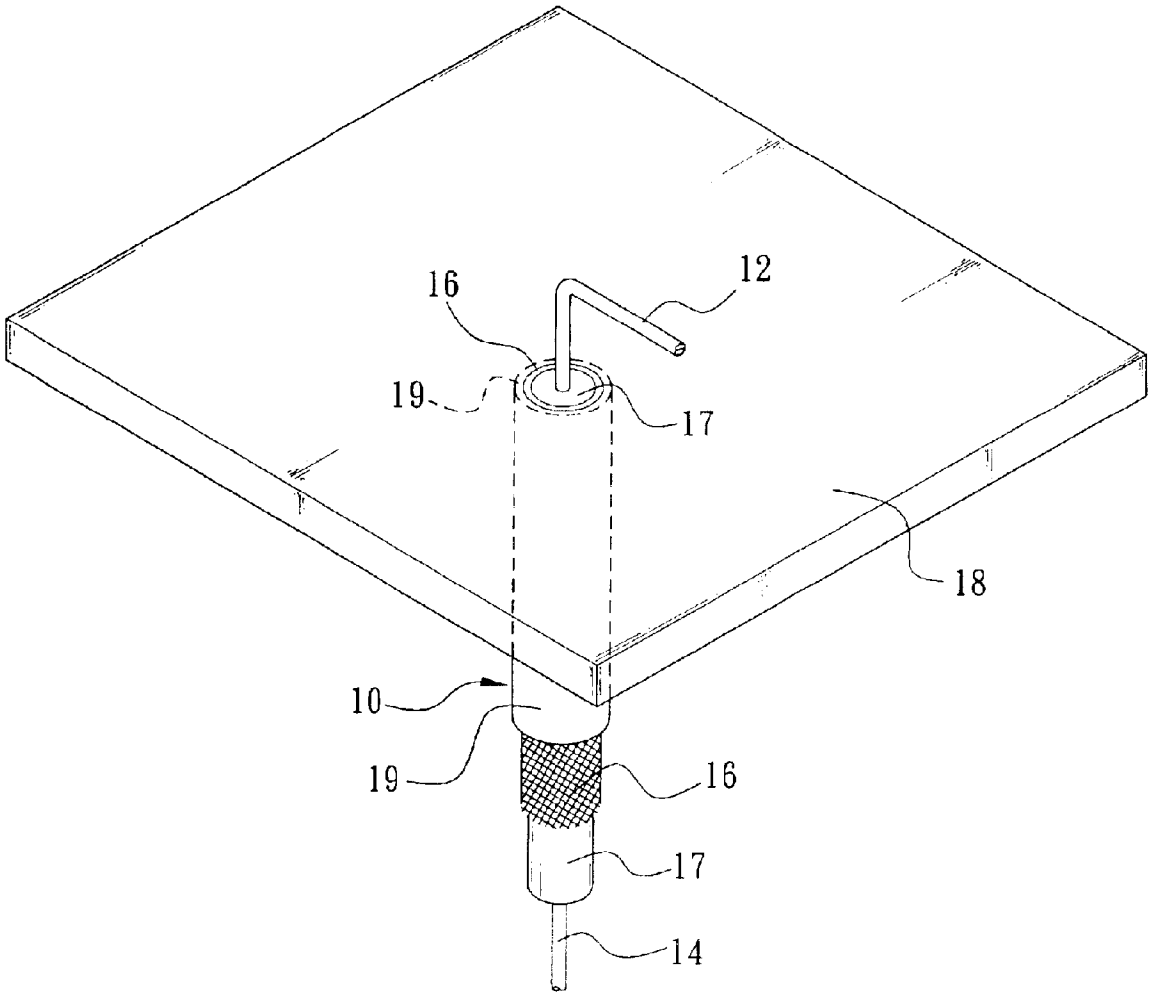
FIG. 1 (Prior Art)
FIG. 1 is a perspective view of a conventional sleeve antenna.
Figure 2:
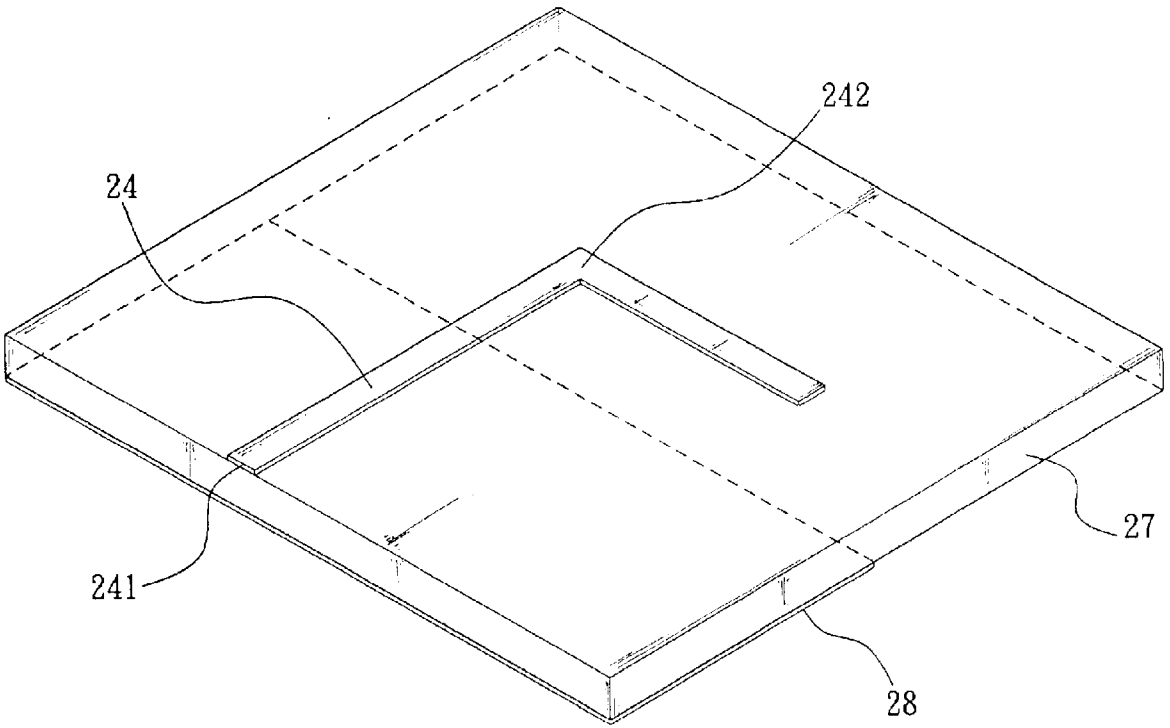
FIG. 2 (Prior Art)
FIG. 2 is a perspective view of a conventional patch based L-shaped antenna.
Figure 3:
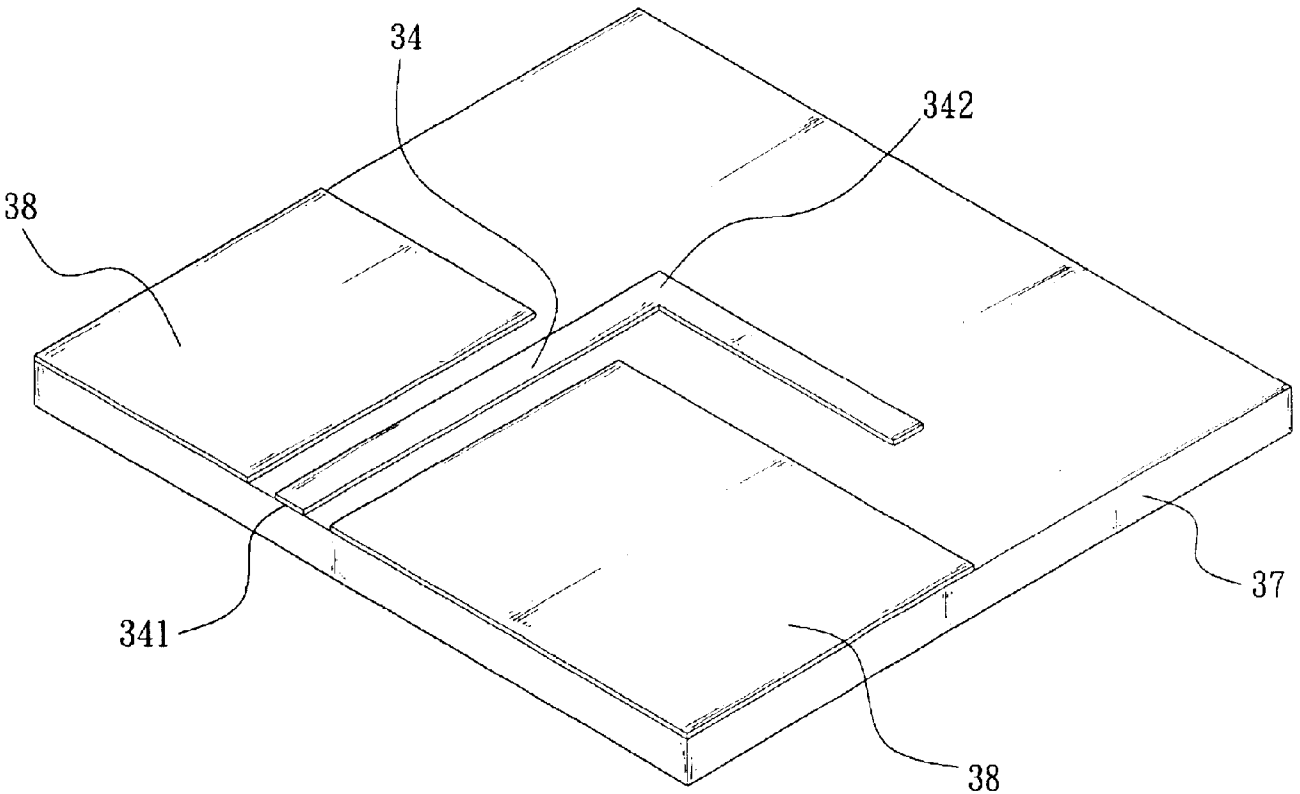
FIG. 3 (Prior Art)
FIG. 3 is a perspective view of a conventional coplanar wave guide based L-shaped antenna.
Figure 4:
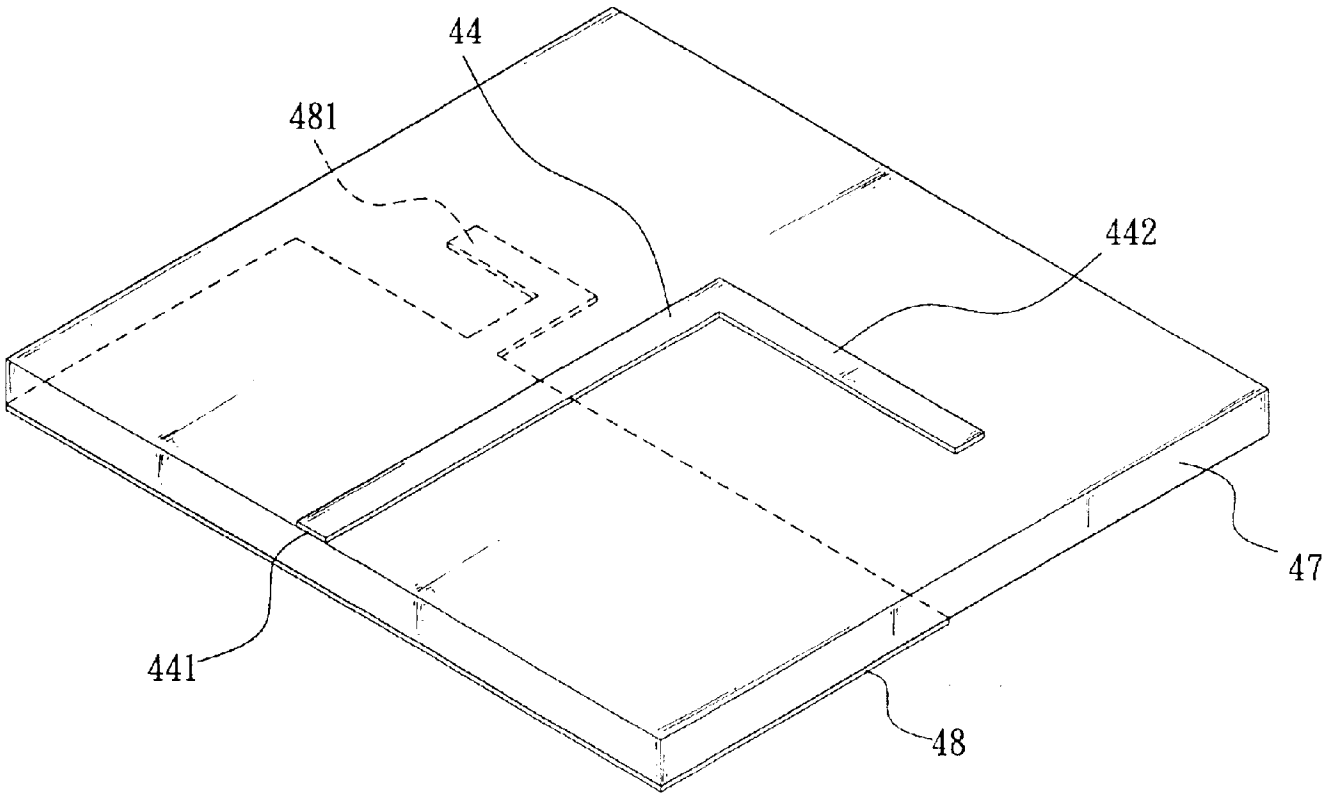
FIG. 4 is a perspective view of a first preferred embodiment of planar double L-shaped antenna of dual frequency according to the invention.

Referring to FIG. 4, there is shown a planar double L-shaped antenna of dual frequency in accordance with a first preferred embodiment of the invention. The antenna comprises a dielectric substrate 47, a patch line 44 printed on the top of the dielectric substrate 47, the patch line 44 having one end formed as a signal feed point 441, a ground metal plate 48 printed on the bottom of the dielectric substrate 47 opposite to the patch line 44, an inverted L-shaped first radiating element 442 formed at the other end of the patch line 44, the inverted L-shaped first radiating element 442 being extended in a direction perpendicular to the patch line 44 above and beyond the ground metal plate 48, and an inverted L-shaped second radiating element 481 of the ground metal plate 48 adjacent the first radiating element 442, the second radiating element 481 being extended beyond the ground metal plate 48. The inverted L-shaped radiating elements 442, 481 are spaced apart and extended in opposite directions so as to receive signals having different frequencies.

In the first preferred embodiment, the radiating elements 442, 481 are designed to receive signals having different frequencies. Hence, a length of each of the radiating elements 442, 481 is closely related to a distinct resonant frequency of a corresponding antenna. In the first preferred embodiment of the invention, preferably, a length of each of the radiating elements 442, 481 is about one-quarter wavelength at each operating frequency of two frequency ranges in which the longer radiating element 442 is used as a radiating element operated at a low frequency and the shorter radiating element 481 is used as a radiating element operated at a high frequency respectively. As an end, the radiating elements 442, 481 of different lengths can receive signals of dual frequency as stipulated by IEEE 802.11a protocol and IEEE 802.11b protocol respectively.

Figure 5:
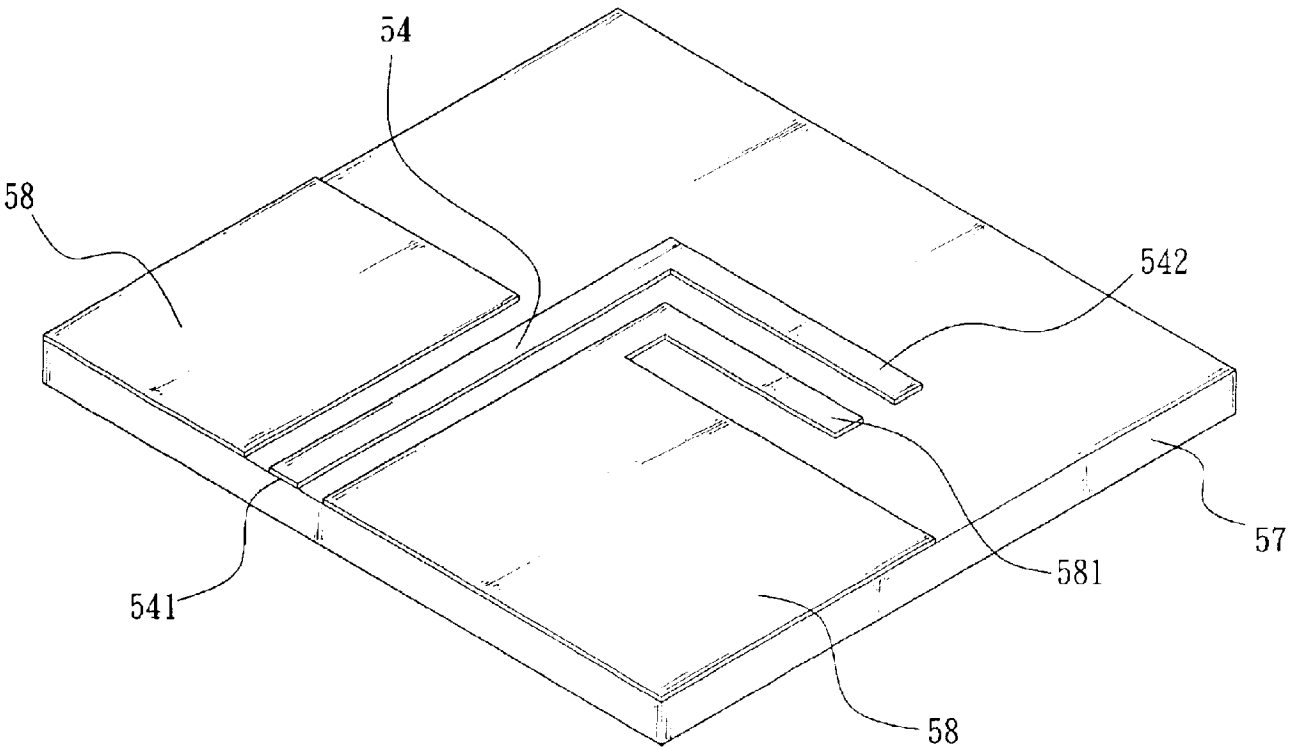
FIG. 5 is a perspective view of a second preferred embodiment of planar double L-shaped antenna of dual frequency according to the invention.

Referring to FIG. 5, there is shown a planar double L-shaped antenna of dual frequency in accordance with a second preferred embodiment of the invention. The antenna comprises a dielectric substrate 57, a coplanar wave guide line 54 printed on the top of the dielectric substrate 57, the coplanar wave guide line 54 having one end formed as a signal feed point 541, two spaced ground metal plates 58 printed on the top of the dielectric substrate 57 (i.e., the same surface as the coplanar wave guide line 54) with the coplanar wave guide line 54 located therebetween and spaced apart, an inverted L-shaped first radiating element 542 formed at the other end of the coplanar wave guide line 54, the inverted L-shaped radiating element 542 being extended in a direction perpendicular to the coplanar wave guide line 54 and beyond the ground metal plates 58, and, an inverted L-shaped second radiating element 581 extended from one of the ground metal plates 58. The radiating elements 542, 581 are spaced apart and extended in the same direction so as to receive signals having different frequencies.

Figure 9:
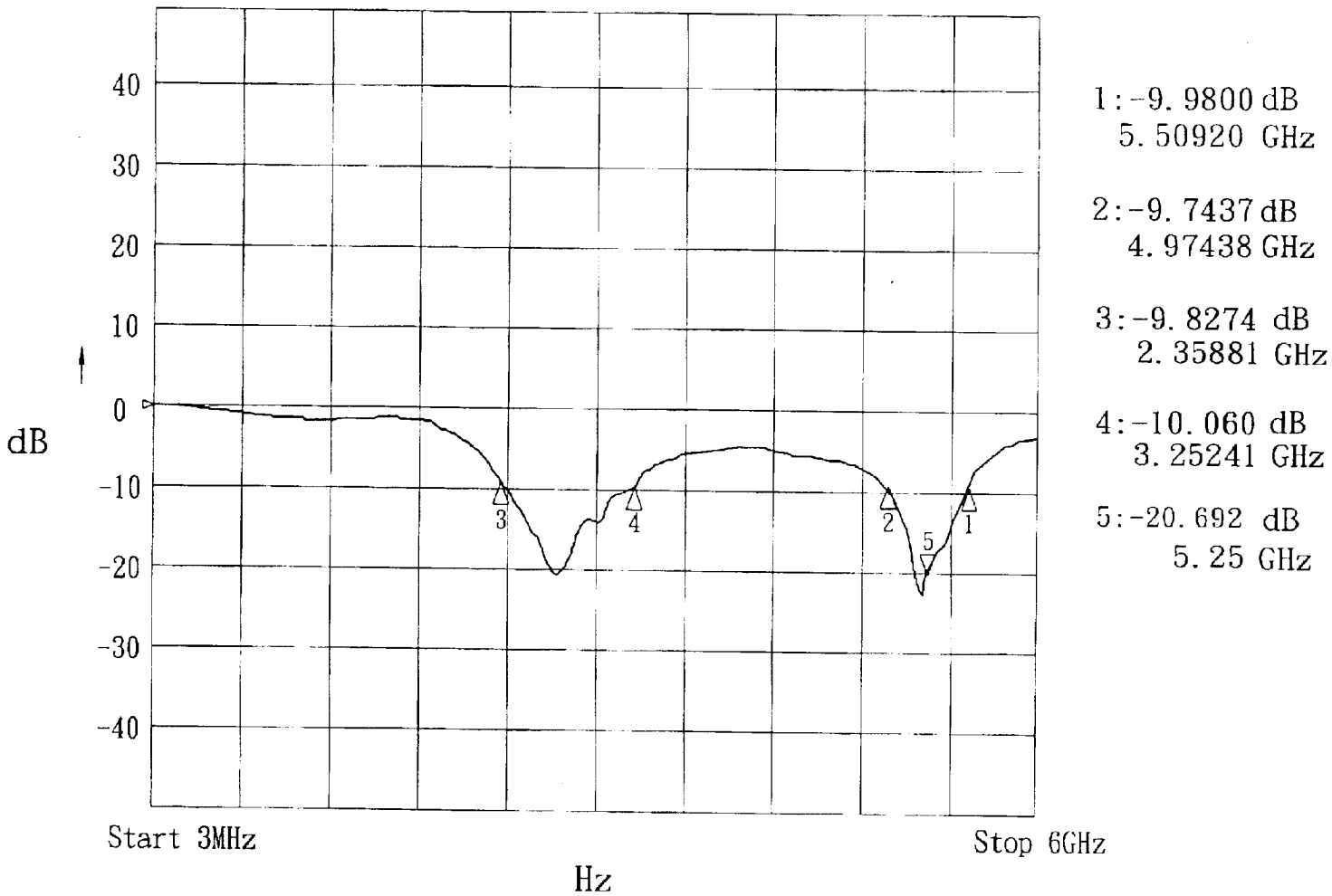
FIG. 9 is a graph showing return loss measured at the antenna of FIG. 5.

In the antenna of the second preferred embodiment of the invention (see FIG. 5), the coplanar wave guide line 54, the radiating elements 542, 581, and the ground metal plates 58 are printed on the top of the dielectric substrate 57 having a thickness about 0.8 mm and a dielectric coefficient from about 4.3 to about 4.7. This forms a planar double L-shaped antenna of dual frequency of the invention. Each of the coplanar wave guide line 54 and the inverted L-shaped radiating elements 542, 581 has a width about 1 mm. A length of the radiating element 542 operated at a low frequency is about 23 mm. A length of the radiating element 581 operated at a high frequency is about 12 mm. The antenna of the second preferred embodiment operates at two frequency ranges from 2.35881 GHz to 3.25241 GHz and from 4.97438 GHz to 5.50920 GHz respectively. A return loss measured at each of the frequency ranges is shown in FIG. 9. It is seen that each return loss is less than 9 dB. In view of the measured return loss, the planar double L-shaped antenna of dual frequency of the invention can receive signals of dual frequency as stipulated by IEEE 802.11a protocol and IEEE 802.11b protocol respectively.

In the second preferred embodiment, the radiating elements 542, 581 are designed to receive signals having different frequencies. Hence, a length of each of the radiating elements 542, 581 is closely related to a distinct resonant frequency of a corresponding antenna. In the second preferred embodiment of the invention, preferably, a length of each of the radiating elements 542, 581 is about one-quarter wavelength at each operating frequency of two frequency ranges in which the longer radiating element 542 is used as a radiating element operated at a low frequency and the shorter radiating element 581 is used as a radiating element operated at a high frequency respectively. As an end, the radiating elements 542, 581 of different lengths can receive signals of dual frequency as stipulated by IEEE 802.11a protocol and IEEE 802.11b protocol respectively.

Figure 6:
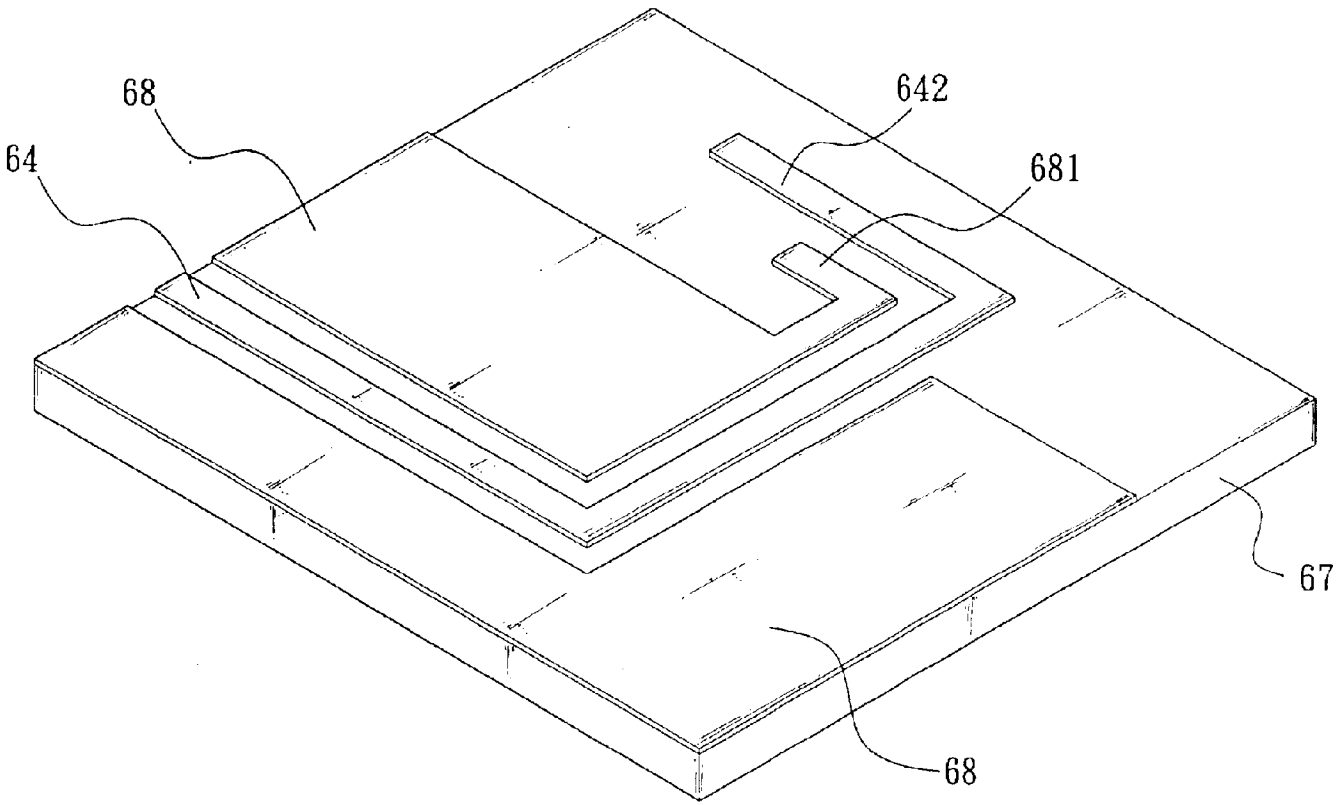
FIG. 6 is a perspective view of a preferred embodiment of coplanar wave guide line shown in FIGS. 4 and 5.
Figure 7:
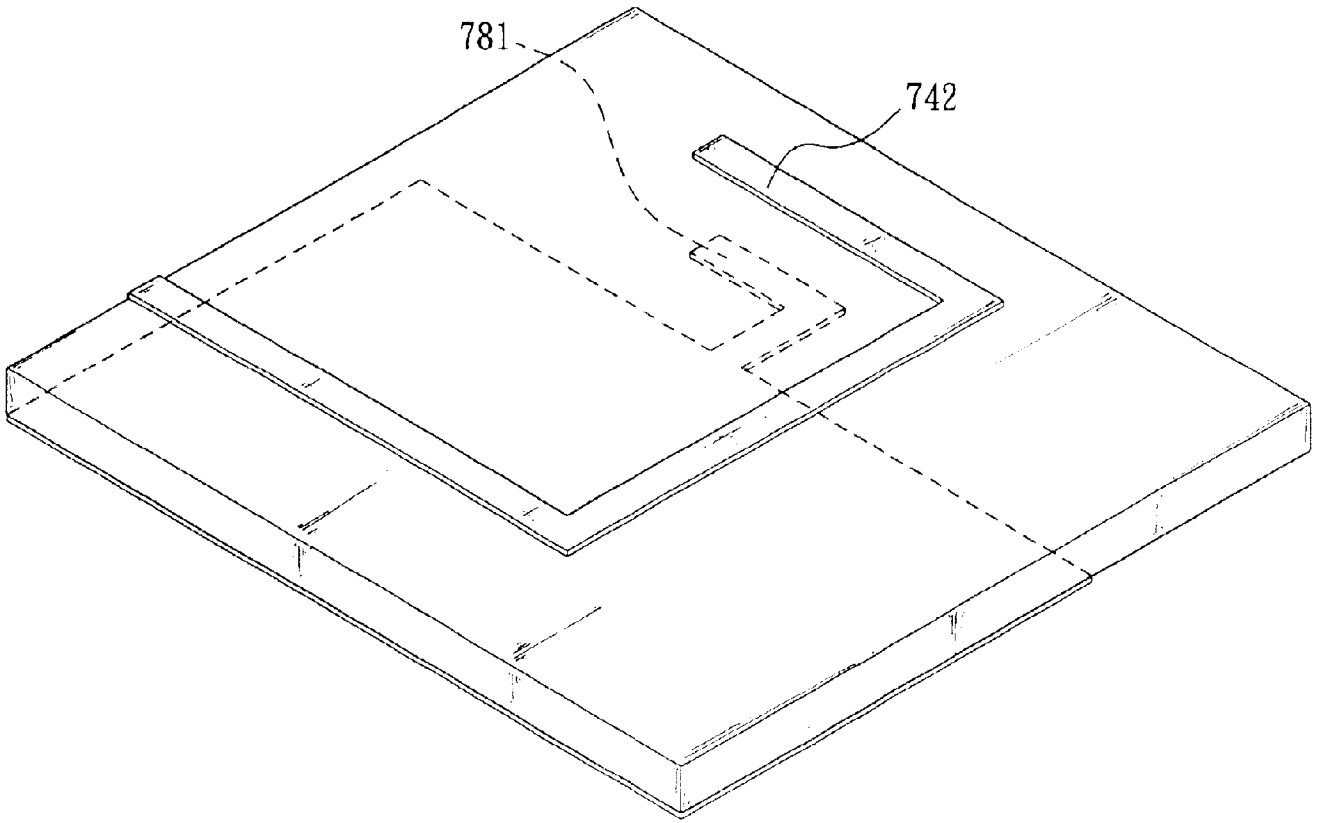
FIG. 7 is a perspective view of a preferred embodiment of radiating elements shown in FIG. 4.
Figure 8:
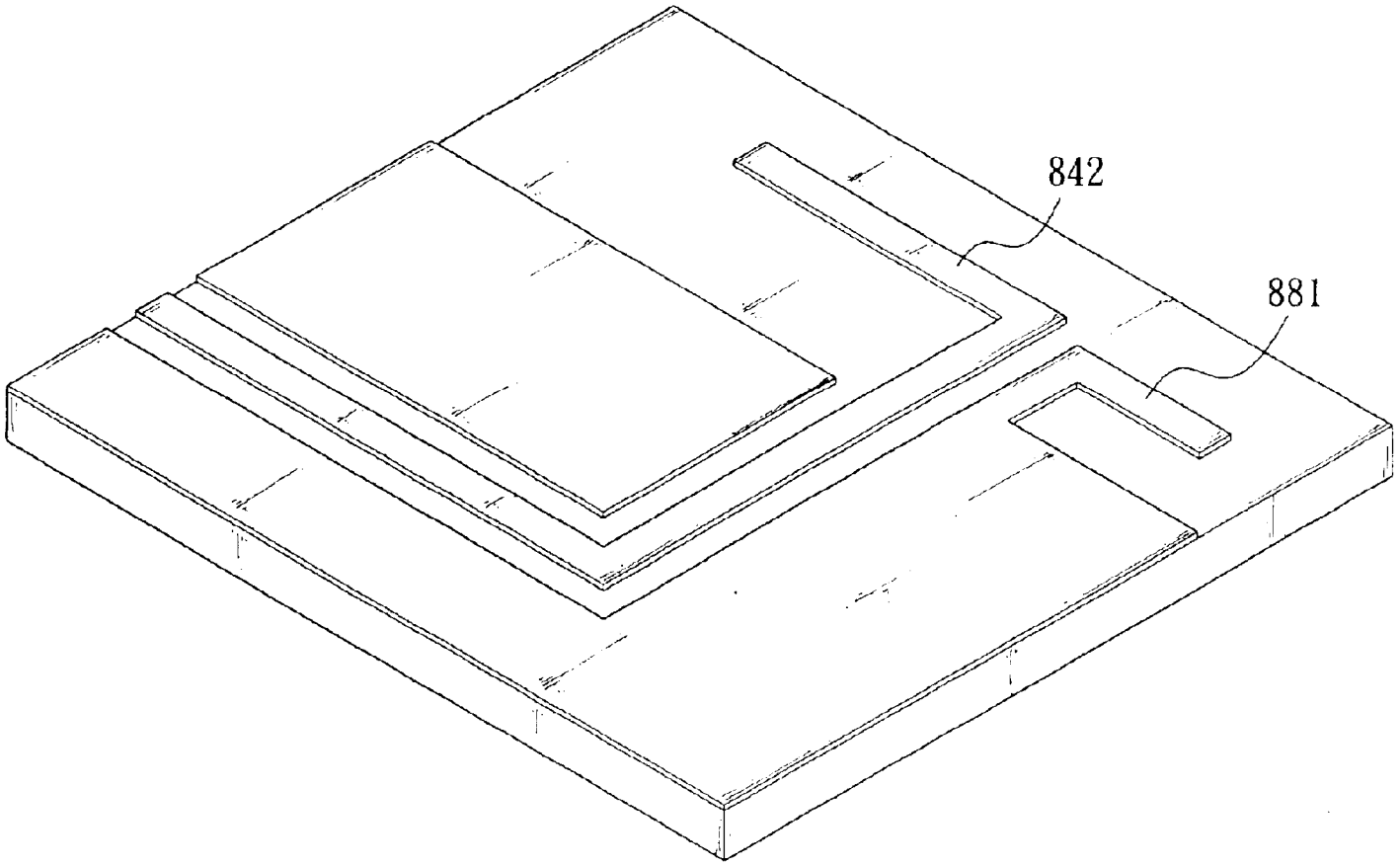
FIG. 8 is a perspective view of a preferred embodiment of radiating elements shown in FIG. 5.

Referring to FIGS. 4 and 5 again, in each of the above preferred embodiments the patch line 44 or the coplanar wave guide line 54 is an elongated, straight line. But in practice the patch line 44 or the coplanar wave guide line 54 of the invention can be formed as a bent coplanar wave guide line 64 depending on applications or characteristic matching as shown in FIG. 6. Also, the radiating elements 442, 481 of the invention shown in FIG. 4 in practice can be formed as radiating elements 742, 781 extended in the same direction depending on applications or characteristic matching as shown in FIG. 7. Moreover, the radiating elements 542, 581 of the invention shown in FIG. 5 in practice can be formed as spaced radiating elements 842, 881 extended in opposite direction depending on applications or characteristic matching as shown in FIG. 8.

In the antenna of the invention (see FIG. 6), the coplanar wave guide line 64, the radiating elements 642, 681, and the ground metal plates 68 are printed on the top of the dielectric substrate 67 having a thickness about 0.8 mm and a dielectric coefficient from about 4.3 to about 4.7. This forms a planar double L-shaped antenna of dual frequency of the invention.

Figure 10:
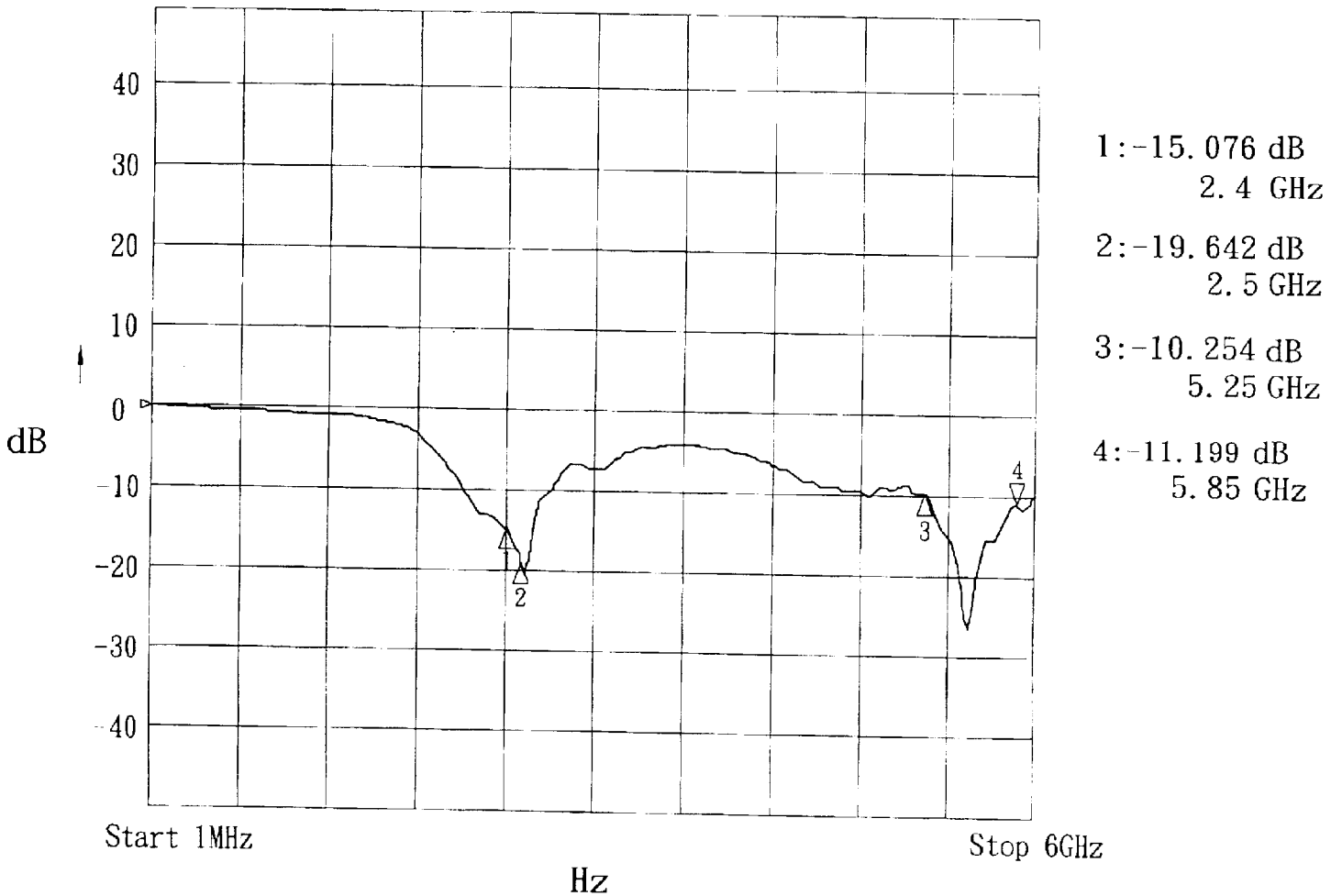
FIG. 10 is a graph showing return loss measured at the antenna of FIG. 4.

Also, in the antenna of the invention as shown in FIG. 4, the patch line 44, the radiating elements 442, 481, and the ground metal plate 48 are printed on the top of the dielectric substrate 47 having a thickness about 0.8 mm and a dielectric coefficient from about 4.3 to about 4.7. This forms a planar double L-shaped antenna of dual frequency of the invention. Each of the patch line 44 and the inverted L-shaped radiating elements 442, 481 has a width about 1 mm. A length of the radiating element 442 operated at a low frequency is about 25 mm. A length of the radiating element 481 operated at a high frequency is about 14 mm. The antenna of the first preferred embodiment operates at two frequency ranges from 2.4 GHz to 2.5 GHz and from 5.25 GHz to 5.85 GHz respectively. A return loss measured at each of the frequency ranges is shown in FIG. 10. It is seen that each return loss is less than 10 dB. In view of the measured return loss, the planar double L-shaped antenna of dual frequency of the invention can receive signals of dual frequency as stipulated by IEEE 802.11a protocol and IEEE 802.11b protocol respectively.

While the invention has been described by means of specific embodiments, numerous modifications and variations could be made thereto by those skilled in the art without departing from the scope and spirit of the invention set forth in the claims.

What is claimed is:

1. A planar double L-shaped antenna operable at two different frequency ranges comprising:

a dielectric substrate;

a patch line printed on a top of the dielectric substrate, the patch line having one end formed as a signal feed point;

a ground metal plate printed on a bottom of the dielectric substrate; and first and second radiating elements wherein the first radiating element is formed at the other end of the patch line, the first radiating element being extended in a direction perpendicular to the patch line above and beyond the ground metal plate to shape as an inverted L and the second radiating element is adjacent the first radiating element, the second radiating element being extended beyond the ground metal plate to shape as an inverted L, and the second radiating element being spaced apart from the first radiating element and extended in a direction opposite to that of the first radiating element so that the first and the second radiating elements are capable of receiving signals having different frequencies.

2. The planar double L-shaped antenna of claim 1, wherein a length of each of the first and the second radiating elements is about one-quarter wavelength at each operating frequency of the frequency ranges.

3. The planar double L-shaped antenna of claim 1, wherein the patch line is a bent patch line.

4. The planar double L-shaped antenna of claim 1, wherein the first and the second radiating elements are spaced apart and extended in opposite direction.

5. The planar double L-shaped antenna of claim 1, wherein the first and the second radiating elements are spaced apart and extended in the same direction.

6. A planar double L-shaped antenna operable at two different frequency ranges comprising:

a dielectric substrate;

a coplanar wave guide line printed on a top of the dielectric substrate, the coplanar wave guide line having one end formed as a signal feed point;

two spaced ground metal plates printed on the top of the dielectric substrate with the coplanar wave guide line located therebetween and spaced apart; and first and second radiating elements wherein the first radiating element is formed at the other end of the coplanar wave guide line, the first radiating element being extended in a direction perpendicular to the coplanar wave guide line and beyond the ground metal plates to shape as an inverted L and the second radiating element is extended from one of the ground metal plates to shape as an inverted L, the second radiating element being spaced apart from the first radiating element and extended in a direction the same as that of the first radiating element so that the first and the second radiating elements are capable of receiving signals having different frequencies.

7. The planar double L-shaped antenna of claim 6, wherein a length of each of the first and the second radiating elements is about one-quarter wavelength at each operating frequency of the frequency ranges.

8. The planar double L-shaped antenna of claim 6, wherein the coplanar wave guide line is a bent coplanar wave guide line.

9. The planar double L-shaped antenna of claim 6, wherein the first and the second radiating elements are spaced apart and extended in opposite direction.

10. The planar double L-shaped antenna of claim 6, wherein the first and the second radiating elements are spaced apart and extended in the same direction.

* * * * *